United States Patent [19]

Rohatensky

[11] 4,168,007

[45] Sep. 18, 1979

[54] SCUBA TANK RACK

[76] Inventor: Peter P. Rohatensky, 1712 E. Cactus Wren Dr., Phoenix, Ariz. 85020

[21] Appl. No.: 899,452

[22] Filed: Apr. 24, 1978

[51] Int. Cl.[2] ..... A47F 7/00

[52] U.S. Cl. ..... 211/71; 248/154

[58] Field of Search ..... 211/71, 78, 13; 248/146, 154, DIG. 7, 127, 310, 311.1, 312, 505, 507

[56] References Cited

U.S. PATENT DOCUMENTS

| | | | |
|---|---|---|---|
| 2,054,341 | 9/1936 | Schroeder | 248/154 |
| 3,062,493 | 11/1962 | Gill et al. | 248/154 X |
| 3,065,857 | 11/1962 | Sanders | 211/71 |
| 3,181,704 | 5/1965 | Thomas | 211/71 X |
| 3,224,595 | 12/1965 | Sherley | 248/DIG. 7 |
| 3,423,102 | 1/1969 | Heldenbrand | 211/71 X |
| 3,565,384 | 2/1971 | Lockwood | 248/146 X |
| 3,791,403 | 2/1974 | Folkerth | 211/71 X |
| 3,884,439 | 5/1975 | Jeninga | 211/71 X |

FOREIGN PATENT DOCUMENTS

| | | | |
|---|---|---|---|
| 1013388 | 12/1965 | United Kingdom | 211/71 |

*Primary Examiner*—Roy D. Frazier
*Assistant Examiner*—Robert W. Gibson, Jr.
*Attorney, Agent, or Firm*—Cahill, Sutton & Thomas

[57] ABSTRACT

A scuba rack for holding four scuba tanks with back packs and regulators attached securely in place. The scuba rack is especially suitable for securing scuba or diving tanks, with accessories attached, in an automobile, on the deck of a boat, raft or the like. A flat bottom support has four shallow cylindrical recesses in its upper surface for accommodating the bottoms of four scuba or diving tanks. The cylindrical recesses are symmetrically arranged about a rigid vertical upright post extending centrally from the bottom support. Four flexible straps are attached to the upper portion of the vertical upright and can be stretched to loop over the valve units of the respective diving tanks to force them inwardly against the vertical upright and downward securely against the bottoms of the cylindrical recesses.

10 Claims, 5 Drawing Figures

SCUBA TANK RACK

BACKGROUND OF THE INVENTION

The invention relates to portable racks for securely holding diving or scuba tanks.

DESCRIPTION OF THE PRIOR ART

Divers commonly use various types of accessories, including tall cylindrical compressed air tanks known as scuba tanks, diver's tanks, or simply tanks. Scuba tanks are available in several standard sizes, the larger of which is an 80 cubic inch capacity tank, 7 and ¼ inches in diameter, and approximately 26 inches high. The most common 72 cubic inch model has slightly smaller dimensions. At the upper end of a scuba tank there is a valve commonly called a J-valve. A "regulator" is connected to a J-valve which permits the scuba diver to breathe normally through a mouthpiece over a wide range of underwater depths. The diver ordinarily utilizes a backpack having straps and buckles thereof for harnessing a scuba tank assembly to the back of the diver. An additional accessory, called a buoyancy compensator (which is a bulky element which can be attached to the scuba tank over the backpack assembly connected to the same scuba tank) is commonly utilized by a scuba diver. The amount of compressed air utilized by a scuba diver in the course of his underwater activities depends on the depth at which he is diving; greater amounts of are are utilized at greater depths. However, on the average, a diver will utilize a full tank of air in 30–40 minutes. In many instances, a scuba enthusiast has to travel a considerable distance from his home in order to reach a suitable scuba diving location, and he normally goes with a number of other scuba enthusiasts. All of the necessary equipment for a diving expedition, including a large number of scuba tanks and accessories, are transported, usually in vehicles such as cars, pick-up trucks, vans or the like, to the chosen scuba diving site. Scuba tanks are very heavy, weighing approximately 40 pounds when fully charged and approximately 30 pounds when empty. The tank is very dangerous, should the valve be accidentally broken off. When fully charged, the tank contains 3000 pounds per square inch of compressed air. If the valve should blow when the tank is in a horizontal position, the compressed air would project the J-valve flying at a tremendous velocity, sufficient to cause death or serious injury to a person struck by it. Because of their great weight, their cylindrical shape, and the sharpness of various accessories commonly attached thereto, scuba tanks are inconvenient and dangerous to handle and transport, because, up to now, there has been no available safe and convenient portable rack for storing scuba tanks, especially scuba tanks with various accessories connected thereto. Consequently, a great deal of damage to other expensive equipment frequently occurs because scuba tanks fall over and/or roll from one position to another in a vehicle or boat. Further, injuries to persons in the same vehicle or boat frequently occur as a result of a scuba tank rolling against the person or as a result of an upright scuba tank falling over or being knocked over. Other types of injuries, such as strained backs, hernias, and the like, frequently result because scuba divers, often clothed in "wet suits," attempt to, or are required to lift one or more scuba tanks from an inconvenient location in order to place them in a desired location or to deploy them for diving use. Certain known racks are constructed of heavy gauge wire welded to form a cage having a plurality of square compartments, wherein a separate scuba tank may be lifted and set in each square compartment. However, such known racks are unsatisfactory because the compartments are approximately eleven inches deep, requiring a scuba diver to lift a full scuba tank at least this height in order to set into or remove it from such a rack. This may be very inconvenient if the scuba diver is soaking wet, wearing a wet suit, weight belt and fins in a boat which is rocking with the waves. Consequently, injuries caused to equipment and divers by scuba tanks are frequent. Another disadvantage of the known wire compartment-type racks is that the tanks are not securely fastened therein. The scuba tanks therefore rattle and clang against each other, thereby causing a distracting and annoying racket when the vehicle or boat moves. A more serious shortcoming of the known scuba tank rack is that some of the above-mentioned backpacks must be removed before a scuba tank is placed in such known racks. This is a very serious inconvenience under the conditions usually prevalent in the boat, raft, or dock from which the scuba divers are diving, and necessitates additional handling of heavy, fully charged scuba tanks. Another problem is that the mouthpiece stage of the regulators which hang by air hoses from the J-valve connections at the upper ends of scuba tanks and buckles from backpacks and the like frequently snag on the wire from which such racks are formed.

U.S. Pat. No. 3,791,403 discloses a rack for holding two tall gas cylinders and includes a support column. However, this rack is totally unsuitable for scuba tanks, because it is narrow and unstable, and because it requires considerable manipulation of a fully charged oxygen tank in order to position it in the rack and securely clamp it in place. U.S. Pat. No. 2,122,897 shows a similar system for accommodating gas cylinders. However, this system is also clearly totally unsuited for the scuba diving environment. The tanks remain in the rack during discharge of oxygen therefrom.

Other patents uncovered in a preliminary search, but deemed less relevant, include U.S. Pat. Nos. 3,193,778; 3,860,048; 3,693,830; and 1,174,185.

There is a great need in the scuba diving equipment field for a rack which can hold a plurality of scuba tanks with various accessories attached and which is convenient and safe to use under normal scuba diving conditions.

SUMMARY OF THE INVENTION

Accordingly, it is an object of the invention to provide an inexpensive, durable, reliable, and portable means of securing scuba tanks.

It is another object of the invention to provide a scuba tank rack which can conveniently hold scuba tanks having back harnesses, regulators, depth gauges and buoyancy compensators, and the like attached thereto.

It is another object of the invention to provide a scuba tank rack which can securely hold four scuba tanks with various accessories attached thereto wherein any one of said scuba tanks can be individually removed without lifting that scuba tank more than approximately one inch in the vertical direction.

It is another object of the invention to provide a scuba tank rack which avoids damage to equipment and injuries to individuals under typical conditions during travel to scuba diving sites and in the course of common scuba diving activities at such scuba diving sites.

It is another object of the invention to provide a scuba tank rack wherein scuba tanks can be securely fastened for temporary storage without necessity of making precise mechanical adjustments.

It is another object of the invention to provide a scuba tank rack which avoids rattling of scuba tanks held therein.

It is another object of the invention to provide a scuba tank rack which holds scuba tanks securely to restrain both lateral and vertical movement of scuba tanks therein.

It is another object of the invention to provide a scuba tank rack which avoids the problem of snagging of various accessories attached to a scuba tank stored therein.

Briefly described, and in accordance with one embodiment thereof, the invention provides a scuba tank rack having a bottom support having a substantially flat lower surface and having four shallow cylindrical recesses in an upper surface thereof arranged around a vertical rigid upright extending centrally from the bottom support. The bottoms of scuba tanks fit, respectively, into the cylindrical recess to restrain lateral movement of the scuba tanks. Four flexible loops engage the upper portion of the vertical upright, and can be stretched to be looped over the necks of the respective scuba tanks and, when released, are sufficiently taut to securely force the scuba tanks inwardly against the upright and downwardly against the bottoms of the cylindrical recesses. In one embodiment of the invention, the upright is shaped to accommodate the cylindrical sides of the scuba tanks being held in place by the loops.

DESCRIPTION OF THE INVENTION

Scuba diving accessories of various kinds are commonly attached to scuba tanks during diving. For example, backpacks, harnesses, regulator valves, pressure gauges, buoyancy compensators and the like are commonly attached to an individual scuba tank. The "environment" wherein it is necessary to temporarily store scuba tanks and various accessories for connection thereto include boats, rafts, and the like from which scuba divers enter the water, which may be ocean water or fresh water. This "environment" also includes docks, large rocks, and the like from which scuba divers may enter the water, and further includes compartments in motor vehicles wherein scuba tanks and associated equipment are stored during travel to and from suitable scuba diving locations.

Figure 1:
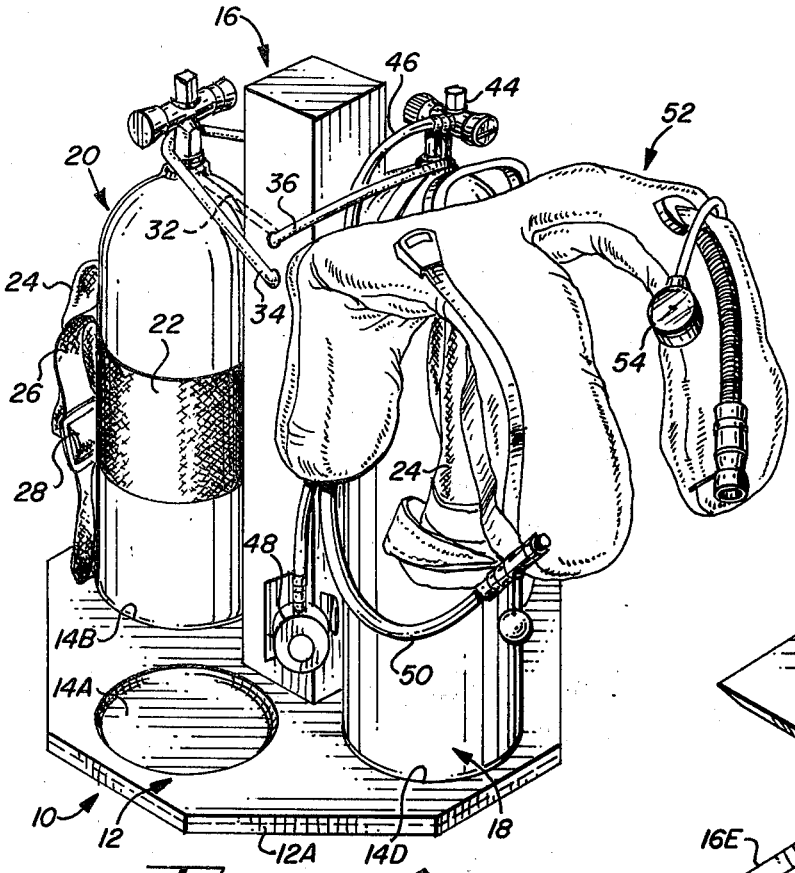
FIG. 1 is a perspective view of the scuba tank rack of the invention showing several scuba tanks with a regulator, backpack and buoyancy compensator attached thereto.

FIG. 1 shows a portable scuba tank rack which is capable of securely storing four scuba tanks with various accessories attached thereto. Referring now to the drawing, portable scuba tank rack 10 includes a bottom support member 12 having four shallow cylindrical recesses 14A, 14B, 14C, and 14D symmetrically arranged in the upper surface thereof above a central portion from which rigid vertical upright member 16 extends. Bottom support 12 may be formed from any suitable material resistant to corrosion by salt water, such as wood, stainless steel, plastic or the like. Vertical upright 16 can also be formed from such materials, and can be attached to bottom support memory 12 by means of screws and/or waterproof cement, or may be integrally formed therewith. In one embodiment of the invention, bottom support member is formed from two layers of $\frac{3}{4}$ inch plywood, as indicated by the dotted line 12A, the upper layer having holes corresponding to the four recesses 14A–14D.

Each of the cylindrical recesses 14A–14D is sufficiently large, approximately 7 and $\frac{3}{8}$ inches, to accommodate the bottom of scuba tanks as 18 and 20. Cylindrical recesses 14A–14D may be approximately $\frac{3}{4}$ inch deep. Slip-proof pads such as 56 may be attached to the under surface of bottom support member 12, if desired.

Figure 2:
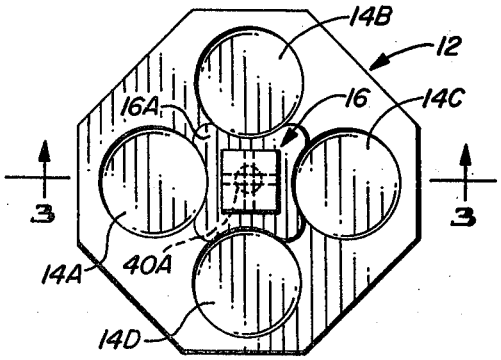
FIG. 2 is a top view of the scuba tank rack of FIG. 1.
Figure 4:
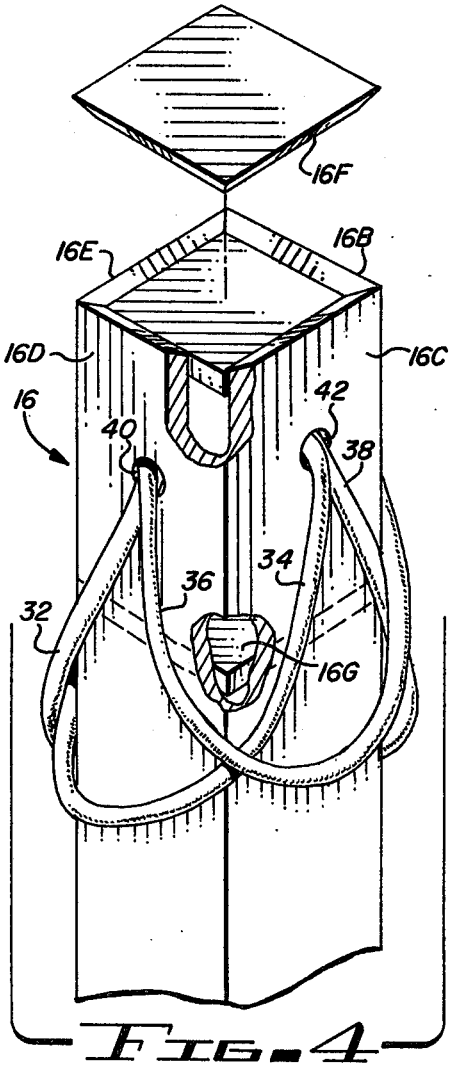
FIG. 4 shows the details of the engagement of the flexible straps utilized to fasten the discharge end of the scuba tanks against the vertical upright.
Figure 3:
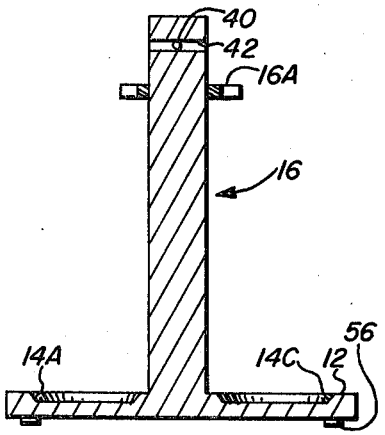
FIG. 3 is a sectional view taken along section lines 3—3 of FIG. 2.

Vertical upright 16, which is approximately 26 inches high, includes holes 40 and 42 located approximately 22 inches from the bottom of upright 15 and extending therethrough and aligned at right angles to each other. Flexible bands 32 and 36 form loops which extend through hole 40, and flexible loops 34 and 38 extend through hole 42. The flexible loops are formed of natural latex or gum rubber surgical tubing, manufactured by Bittener Corporation and, when stretched, engage the upper necks of scuba tanks positioned in the various cylindrical recesses 14A–14D and exert an inward and a downward force which pulls the scuba tanks horizontally against vertical upright 16 and downward against the bottoms of cylindrical recesses 14A–14D. The surgical tubing, which has an inside diameter of 3/16 inch and a wall thickness of 3/32 inch, is tied in knots to form the loops. The knots are concealed in a hollow portion 40A of upright 16, as indicated in FIG. 2. Upright 16 may be a 4 inch by 4 inch post. In this case, the hollow portion 40A may be formed by drilling a hole of larger diameter (at least 2 inches in diameter) than holes 40 and 42 (FIG. 4) downward through the top of upright 16. Or, alternatively, upright 16 may be formed of four mitered sections 16B, 16C, 16D and 16E and mitered top 16F all glued together as indicated in FIG. 4. Several internal square braces such as 16G are disposed inside the hollow column thus formed, as also shown in FIG. 4.

A guide member 16A may optionally be connected to vertical upright 16 to accommodate the cylindrical walls of the scuba tanks in portable scuba tank rack 10. Alternatively, vertical upright 16 may have shaped and/or enlarged side walls which mate with the cylindrical walls of the various scuba tank when the scuba tanks are pulled against vertical upright 16 by means of taut flexible securing straps 32, 34, 36 and 38.

As indicated in FIG. 1, various accessories are commonly attached to a scuba tank as it is utilized by a scuba diver. For example, scuba tank 20 includes a backpack 24 connected to scuba tank 20 by means of strap 22. A strap 26 having a buckle 28 thereof securely engages backpack 24. Scuba tank 18 includes a regulator having a first stage 44, a hose 46 extending from first stage 44 to second or mouthpiece stage 48. A backpack (not shown) is also connected to scuba tank 18 so that a scuba diver can readily strap the entire tank assembly on his pack prior to entering the water. A buoyancy compensator 52 having a guage 54 and compensator hose 50 connected thereto is strapped onto scuba tank 18.

Thus, it is seen that the portable scuba tank rack 10 of the present invention conveniently and easily accommodates four scuba tanks each having a variety of scuba diving accessories attached thereto. Each scuba tank needs to be lifted only approximately an inch in order to position it in one of the cylindrical recesses 14A–14D. A single motion of one hand is all that is required to stretch one of the surgical tubing flexible straps over the neck of a scuba tank to securely hold it in place. The inward and downward force applied by the respective flexible securing straps prevent the scuba tank from rattling and bouncing out of the shallow cylindrical recesses as, for example, a rack of tanks is being transported in a bed of a pick-up truck along a rough road to or from a desirable scuba diving location. Injuries to equipment and to scuba divers associated with unracked scuba tanks rolling or falling are avoided by the rack of the present invention. Injuries due to attempts by wet scuba divers working on unstable surfaces such as in a rocking boat or on a sloping rock, to handle heavy, fully charged scuba tanks in order to place such scuba tanks into previous racks or to remove them therefrom are avoided by the present rack. Further, inconvenience and injuries resulting by attempts by scuba divers to connect or disconnect various accessories, such as regulators, backpacks and buoyancy compensators and the like, to scuba tanks after they have been removed from prior racks (which do not accommodate scuba tanks with the above-described accessories attached thereto) are avoided by the invention. Further, the scuba tank rack of the invention may be readily constructed from durable, relatively low cost materials, and is therefore basically reliable but inexpensive device.

Figure 5:
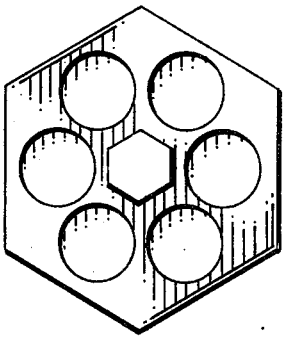
FIG. 5 is a top view of an alternate embodiment of the invention.

Of course, those skilled in the art will readily recognize that variations in the materials and arrangements of the above-described elements are included within the scope of the invention as described herein and in the appended claims. For example, multiple uprights and groups of shallow cylindrical recesses can be provided on a single bottom support member. Or, for example, an hexagonal shaped bottom support member and hexagonal shaped vertical upright can be provided, as shown in FIG. 5, to provide a rack for storing six scuba tanks. Alternatively, a continued line of tanks may be placed in a row on a boat deck by fastening surgical tubing to a wall at a height of approximately twenty-two inches above a plurality of cylindrical recesses on the floor.

I claim:

1. A portable rack for holding four cylindrical tanks securely in place, said rack comprising in combination:

(a) a bottom support means having an upper surface and a lower surface and including four retaining means in said upper surface for retaining the bottoms of said four cylindrical tanks, respectively, said four retaining means being arranged substantially symmetrically about a central portion of said upper surface of said bottom support means;

(b) upright means rigidly extending vertically from said central portion of said upper surface for laterally supporting four cylindrical tanks positioned on said bottom support means and having their bottoms respectively retained by said retaining means; and (c) four flexible securing means engaged with said upright means for looping tautly over the necks of said four cylindrical tanks, respectively, to hold said four cylindrical tanks firmly against said upright means, wherein each of said flexible securing means includes a flexible strand passing through an opening in said upright means, said flexible strand forming a loop, said loop having a length such that when said loop is stretched to engage the neck of one of said cylindrical tanks said loop is sufficiently taut to force said cylindrical tank securely against said upright means and wherein said loop extends both upwardly and outwardly from said opening to the neck of said cylindrical tank to produce a downward component of force on said cylindrical tank tending to force said cylindrical tank tightly against said bottom support means and a horizontal component force tending to force said cylindrical tank against said upright means.

2. The portable rack of claim 1 wherein said upright means is rigidly attached to said bottom support means.

3. The portable rack of claim 1 wherein said upright means is integral with said bottom support means.

4. The portable rack of claim 1 further including a plurality of pads attached to said lower surface.

5. The portable rack of claim 1 wherein said upright means includes means for aligned engagement of the cylindrical walls of said cylindrical tanks, such that said flexible securing means urges said cylindrical tank against said aligning means.

6. The portable rack of claim 1 wherein said bottom support means upper surface and lower surface are substantially flat.

7. The portable rack of claim 1 wherein said bottom support means and said upright means are formed from substance resistant to corrosion by salt water.

8. The portable rack of claim 1 wherein said bottom support means and said upright means are formed from wood.

9. The portable rack of claim 1 wherein said bottom support means and said upright means are formed from plastic.

10. The portable rack of claim 1 wherein said strand is flexible surgical tubing and said loop is formed by forming a knot of larger diameter than said opening at one end of said strand, said upright having an enlarged hollow space therein for concealing said knot, whereby said knot is retained within said hollow space by said opening.

* * * * *